US005955833A

United States Patent [19]

Janning

[11] Patent Number: 5,955,833

[45] Date of Patent: Sep. 21, 1999

[54] FIELD EMISSION DISPLAY DEVICES

[75] Inventor: John L. Janning, Dayton, Ohio

[73] Assignee: St. Clair Intellectual Property Consultants, Inc., Grosse Pointe, Mich.

[21] Appl. No.: 09/069,443

[22] Filed: Apr. 29, 1998

Related U.S. Application Data

[63] Continuation-in-part of application No. 08/852,228, May 6, 1997, and application No. 08/955,880, Oct. 22, 1997.

[51] Int. Cl.[6] ..... H01J 29/46

[52] U.S. Cl. ..... 313/495; 313/336; 313/309; 313/351; 313/103 R; 313/496; 313/103 CM

[58] Field of Search ..... 313/495, 496, 313/497, 422, 336, 351, 309, 103 R, 105 R, 103 CM, 105 CM

[56] References Cited

U.S. PATENT DOCUMENTS

| | | | |
|---|---|---|---|
| 2,992,349 | 7/1961 | Cusano . | |
| 3,560,784 | 2/1971 | Steel . | |
| 4,381,474 | 4/1983 | Cusano . | |
| 4,540,914 | 9/1985 | Maple . | |
| 5,378,963 | 1/1995 | Ikeda | 313/495 |
| 5,438,240 | 8/1995 | Cathey et al. . | |
| 5,461,280 | 10/1995 | Kane . | |
| 5,473,219 | 12/1995 | Ikeda | 313/497 |
| 5,509,839 | 4/1996 | Liu . | |
| 5,534,749 | 7/1996 | Ohoshi et al. . | |
| 5,656,887 | 8/1997 | Voshell et al. | 313/496 |

OTHER PUBLICATIONS

Dr. Jacques I. Pankove, "Electroluminescence", Spring–Verlag Berlin Heidelberg New York 1977, pp. 197–210.

*Primary Examiner*—Nimeshkumar D. Patel
*Attorney, Agent, or Firm*—Harness, Dickey & Pierce, P.L.C.

[57] ABSTRACT

A cathodoluminescent field emission display device features an enhancement layer disposed over at least selected portions of an outer surface of an extraction grid of the device. The enhancement layer provides enhanced secondary electron emissions. The enhancement layer is preferably near mono-molecular film of an oxide of barium, beryllium, calcium, magnesium, strontium or aluminum.

8 Claims, 1 Drawing Sheet

FIELD EMISSION DISPLAY DEVICES

This is a continuation-in-part of U.S. patent application Ser. No. 08/852,228, filed May 6, 1997 and a continuation-in-part of U.S. patent application Ser. No. 08/955,880, filed Oct. 22, 1997.

This invention relates to electronic field emission display devices, such as matrix-addressed monochrome and full color flat panel displays in which light is produced by using cold-cathode electron field emissions to excite cathodoluminescent material. Such devices use electronic fields to induce electron emissions, as opposed to elevated temperatures or thermionic cathodes as used in cathode ray tubes.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric field can be achieved at lower voltage levels.

Each FED emitter is typically a miniature electron gun of micron dimensions. When a sufficient voltage is applied between the emitter tip or edge and an adjacent extraction gate, electrons quantum mechanically tunnel out of the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures in an arc type path, over the gate electrodes and back downwardly to strike the adjacent phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage of a highly nonlinear current-voltage field emission characteristic, which permits direct x-y addressability without the need of a transistor at each pixel. Also, each pixel can be operated by its own array of FED emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

While extensive research and development has been devoted to FEDs in recent years, the noted problems essentially remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies, and with greater cathode to anode voltage level flexibility.

Another object of the invention is to increase the efficiency of electron emissions within a field emission display device.

SUMMARY OF THE INVENTION

To achieve enhanced secondary electron emissions within the FED, an amplification enhancement layer is applied over at least selected portions of an outer surface of an extraction grid of an otherwise conventional FED employing point-type emitter structures. Preferably, the enhancement layer will include an oxide of barium, beryllium, calcium, magnesium, strontium or aluminum. Preferably, the amplification enhancement layer will be near mono-molecular in thickness.

The objects, features and advantages of the invention will become apparent from the further descriptions and the attached drawings.

DETAILED DESCRIPTION OF THE PRESENTLY PREFERRED EMBODIMENTS

Figure 1:
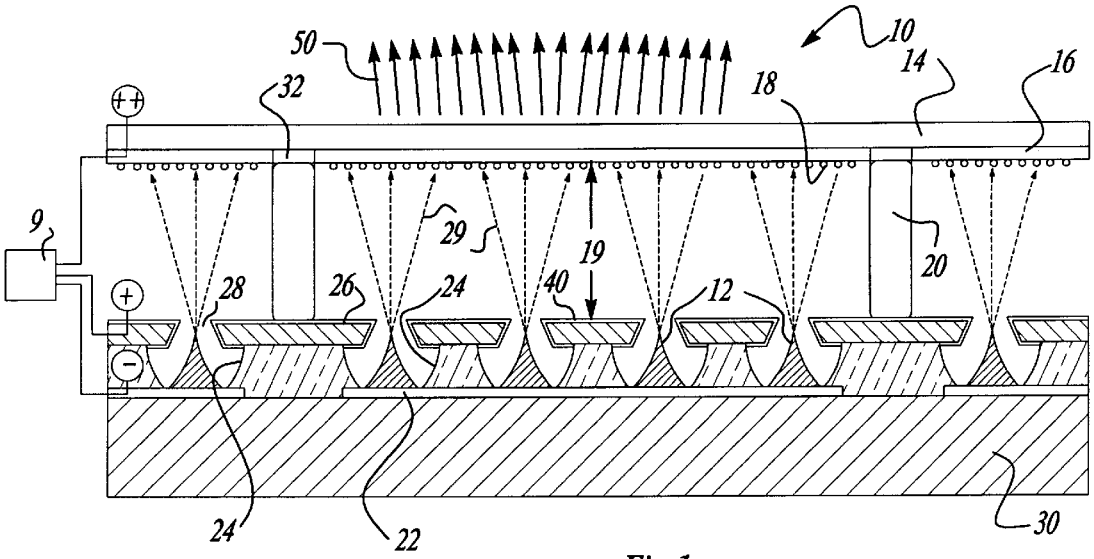
FIG. 1 is a cross sectional schematic view of an exemplary field emission display device arranged in accordance with the principles of the invention.

FIG. 1 schematically depicts an exemplary field emission display (FED) device 10. This flat panel display comprises an x-y electrically addressable matrix of cold-cathode point-type (alternatively called microtip or "Spindt" type) field emitters 12 opposing a faceplate 14 coated with a transparent conductor layer 16 and a phosphor light emissive layer 18 producing light emission 50. A distance or gap 19, which may be on the order of 100 to 200 $\mu$m, is maintained between the emitters 12 and the phosphors 18 by spacers 20. The volume of space between the emitters 12 and the phosphors 18 is evacuated to provide a vacuum environment. This environment is generally gettered (by means not illustrated)

to mitigate against contamination of the internal parts, and to maintain the vacuum.

As illustrated, each emitter 12 has the shape of a cone and can be coupled at its base to an addressable emitter electrode conductor strip or layer 22, through which the emitter 12 is biased as a cathode having a negative voltage, via power supply 9, with respect to the conductor 16 which serves as the anode. Adjacent conductor strips 22 can be electrically separated by extensions of a dielectric insulator structure 24 that also separates adjacent emitters 12. A conductive electron extraction grid 26 is positively biased as a gate electrode with respect to the emitters 12, and has apertures 28 through which emitted electrons 29 have a path from the emitters 12 to the phosphors 18. The extraction grid 26 can be an addressable strip, orthogonal to the conductors 22, for servicing a row or column of matrix groups of emitters 12. In that case there would typically be a multiplicity of orthogonal extraction grids 26 and conductor strips 22 used within the FED 10. As shown, the extraction grid 26 is spaced and electrically isolated from the conductors 22 by the insulator structure 24. The emitters 12 and the conductors 22 are formed on a substrate or base plate 30.

This invention modifies a conventional extraction grid by incorporating an enhancement layer 40 of near monomolecular thickness (e.g. 10 to 15 Angstroms) over at least selected portions of an outer surface of the extraction grid 26. The selected portions are chosen such that the enhancement layer 40 will have maximum exposure to electrons emanating from emitters 12. As shown in FIG. 1, layer 40 is placed over the entire exposed surface of grid 26, but the most effective portion of layer 40 is probably that portion covering a surface of apertures 28 in the vicinity of the tips of emitters 12.

Layer 40 comprises a high secondary electron emission material such as an oxide of barium, beryllium, calcium, magnesium, strontium or aluminum. Oxides of magnesium, beryllium and aluminum are believed to be particularly effective. Use of layer 40 enables improved display brightness levels and/or a reduction in the number of emitters 12 required for acceptable operation of the display 10.

Preferably, the underlying grid structure 26 is fabricated from a high amplification factor material such as copper-beryllium, silver-magnesium, gold-barium, copper-barium, tungsten-barium-gold or gold-calcium. Other such materials with the requisite amplification properties are rubidium-antimony, other alkali alloy or compounds, alkali halides and oxidized earth alkali alloys. Preferably, layer 40 would comprise magnesium oxide in association with a grid 26 material of silver magnesium, beryllium oxide in association with a grid 26 material of copper-beryllium, or calcium oxide in association with a grid 26 material of gold-calcium.

The extraction grid potential may be modulated (e.g. by voltage level, pulse width or duty cycle) for display brightness or gray scale control.

Figure 2:
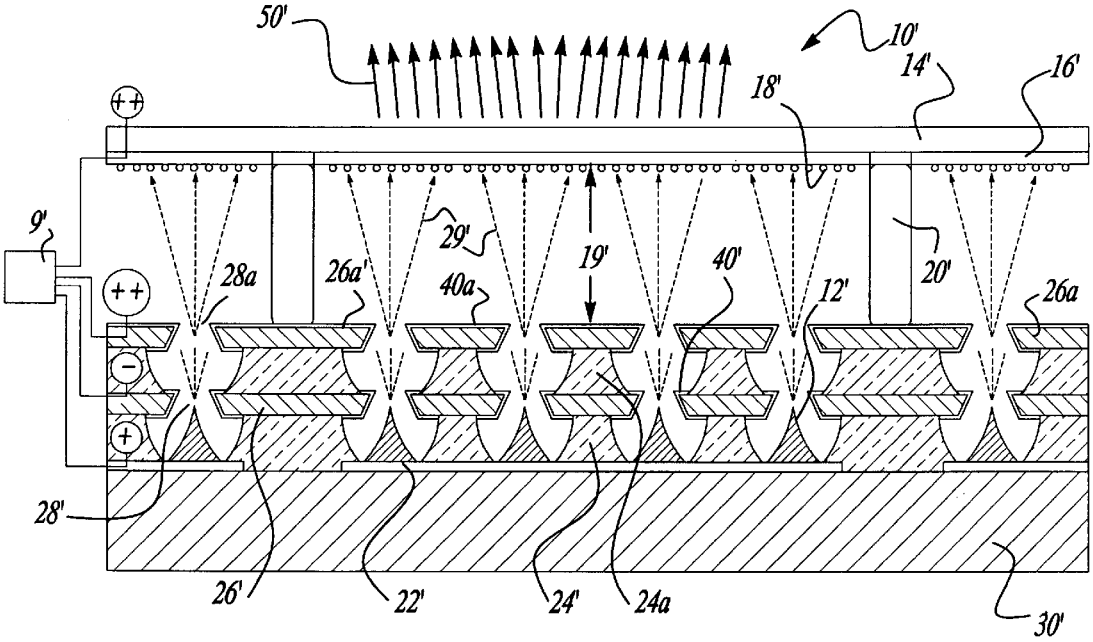
FIG. 2 is a cross sectional schematic view of an alternative embodiment of a field emission display device of the invention.

The alternative embodiment of FIG. 2 depicts FED display 10' having similar microtip emitter structures 12', but with one or more dynodes or amplification grids **26*a* with near monomolecular enhancement layers 40*a* for staged secondary electron emissions. Layers 40*a* are particularly effective when placed upon the surfaces of apertures 28*a*. The exposed surfaces of underlying grid structures 26' likewise have enhancement layers 40' deposited thereon, especially on the surface of apertures 28'. The underlying grid structures 26' and 26*a* are preferably fashioned from the same high amplification factor materials as set forth above with respect to the embodiment of FIG. 1. By way of background, the edge-type grid amplification stages 26' and 26*a* are similar to the arrangement of FIG. 6 of parent application Ser. No. 08/955,880, but in this embodiment of FIG. 2, conventional point or Spindt-type or microtip emitters 12'** are used.

It is to be understood that the enhancement layers 40, 40' and **40*a* may be used in either embodiment of FIGS. 1 and 2** in conjunction with any extraction grid material, whether or not such grid material exhibits high amplification properties.

The amplification enhancement layer may be deposited by conventional sputtering from a conditioned alloy target or, for example, by a co-sputtering process. To illustrate, a lightly oxidized beryllium target may be prepared by moving a target from room-temperature, ambient conditions to an oven at about 250° C. for about 30 minutes, converting the exposed beryllium surface to Be—O. The resulting lightly oxidized target can then be introduced along with a second, copper target for use within a sputtering chamber which is evacuated and back-filled with argon to a pressure of approximately one to ten microns. By sputtering initially from the beryllium target only, a near mono-molecular beryllium oxide layer may be deposited.

While the presently preferred embodiments of the invention have been illustrated and described, it will be understood that those and yet other embodiments may be within the scope of the following claims.

What is claimed is:

1. In a field emission display device including at least one cathode point-type emitter structure, each cathode emitter underlying an aperture in a conductive extraction grid, the improvement comprising:

an enhancement layer disposed over an outer surface of the extraction grid for providing enhanced secondary emissions of electrons within the device.

2. The device of claim 1 wherein the enhancement layer is near monomolecular in thickness.

3. The device of claim 2 wherein the enhancement layer is fashioned from material exhibiting high secondary electron emissions when bombarded by electrons.

4. The device of claim 2 wherein the enhancement layer is fashioned from material selected from the group comprising oxides of barium, beryllium, calcium, magnesium, strontium and aluminum.

5. The device of claim 1 wherein the extraction grid is fashioned from material exhibiting high secondary electron emissions when bombarded by electrons.

6. The device of claim 1 wherein the extraction grid is fashioned from material selected from the group comprising copper-beryllium, silver-magnesium, gold-barium, copper-barium, tungsten-barium-gold and gold-calcium.

7. The device of claim 2 wherein the enhancement layer is fashioned from material selected from the group comprising oxides of beryllium, magnesium and aluminum.

8. In a field emission display device including at least one cathode point-type emitter structure, the improvement comprising:

a plurality of extraction grids each having an aperture aligned over each point-type emitter structure; and an enhancement layer disposed over an outer surface of each extraction grid for providing enhanced secondary emissions of electrons within the device.

* * * * *